US006168027B1

(12) United States Patent
Esser

(10) Patent No.: US 6,168,027 B1
(45) Date of Patent: Jan. 2, 2001

(54) SHIPPING/DISPLAY BOX HAVING TEAR-OUT SEGMENTS

(75) Inventor: Jeffrey R. Esser, Florence, SC (US)

(73) Assignee: Fort James Corporation, Deerfield, IL (US)

( * ) Notice: Under 35 U.S.C. 154(b), the term of this patent shall be extended for 0 days.

(21) Appl. No.: 09/419,791

(22) Filed: Oct. 18, 1999

Related U.S. Application Data

(60) Provisional application No. 60/104,719, filed on Oct. 19, 1998.

(51) Int. Cl.[7] ..... B65D 5/54

(52) U.S. Cl. ..... 206/738; 206/767; 206/774

(58) Field of Search ..... 206/738, 767, 206/772, 773, 774, 736

(56) References Cited

U.S. PATENT DOCUMENTS 3,942,631 * 3/1976 Sutherland et al. ..... 206/738
5,826,728 * 10/1998 Sheffer ..... 206/774
5,881,884 * 3/1999 Podosek ..... 206/744

* cited by examiner

*Primary Examiner*—Jacob K. Ackun
(74) *Attorney, Agent, or Firm*—Burns, Doane, Swecker & Mathis, LLP

(57) ABSTRACT

A cardboard box suitable for both shipping and displaying articles is in the form of a box having six sides and eight corners. A vertical divider panel disposed inside the box is oriented perpendicularly to front and rear sides of the box. The front side and a top side of the box include perforations defining a tear-out segment. The tear-out segment includes a front portion disposed in the front side of the box, and a top portion disposed in the top side of the box. The tear-out segment is spaced from all eight corners of the box.

13 Claims, 4 Drawing Sheets

SHIPPING/DISPLAY BOX HAVING TEAR-OUT SEGMENTS

RELATED INVENTION

This application claims the benefit of U.S. Provisional Application Ser. No. 60/104,719, filed on Oct. 19, 1998.

BACKGROUND OF THE INVENTION

The present invention relates to a shipping/display box which can be used for shipping items to a store and then displaying the items in the store.

It is conventional to employ a box, such as a corrugated cardboard box, as a shipping container for shipping items to a store and then as a display container for displaying the items in the store. That is, a front panel of the box would include perforations enabling portions of the panel to be torn-away, exposing the items disposed inside. The items, such as packages of paper plates, for example, would be oriented in parallel vertical planes, with their flat sides facing forwardly. The packages would be arranged in horizontal rows, four in number, and the rows would be parallel to one another. Thus, the packages of each row would be arranged one behind the other. A horizontal shelf would divide the interior of the box into upper and lower halves, with two lower rows disposed below the shelf, and two upper rows seated on the shelf.

Such display boxes have been successfully used, but room for improvement remains. For example, during shipping, the boxes are stacked one above the other. The plates, oriented in vertical planes, would reinforce the top panel of their box against vertical loads. However, regions of the top panel located between the two upper rows of plates would not be reinforced.

During shipment and display, the packages disposed above (and beneath) the shelf are not horizontally separated and tend to shift around to such an extent that they are no longer arranged in neatly ordered stacks when the box is opened for display.

Also, when the box is in a display mode, only the front of each package is exposed (through the torn-away portion of the front panel). That makes it difficult for a customer to grab a package, especially if the customer's eyes are located higher than the torn-away portion. It is also difficult to grab packages from the lower row due to the horizontal shelf separating the upper and lower rows of packages.

In addition, the known box consists of a multitude of pieces (e.g., seven) and is thus relatively expensive to make. Moreover, the box is not well suited to being loaded with items by known automated loading machines.

SUMMARY OF THE INVENTION

The present invention relates to a shipping/display box which includes a horizontal top side, a horizontal bottom side, parallel front and rear vertical sides interconnecting the top and bottom sides, and parallel vertical end sides each interconnecting the top and bottom sides. A vertical divider panel is disposed inside the box and extends perpendicular to the front and rear sides and parallel to the end sides. At least a portion of an upper edge of the divider panel supports the top side from below. The front side and top side include perforations defining a tear-out segment. The tear-out segment includes a front portion disposed in the front side, and a top portion disposed in the top side. The tear-out segment includes a front portion disposed in the front side, and a top portion disposed in the top side, the front portion including a pair of vertical legs spaced apart by an upstanding strip of the front side, the strip is secured to a front vertical edge of the divider panel.

The box forms eight corners, and the tear-out segments are spaced from all of those eight corners.

BRIEF DESCRIPTION OF THE DRAWINGS

The objects and advantages of the invention will become apparent from the following detailed description of preferred embodiments thereof in connection with the accompanying drawing in which like numerals designate like elements and in which.

DETAILED DESCRIPTION OF A PREFERRED EMBODIMENT OF THE INVENTION

Figure 1:
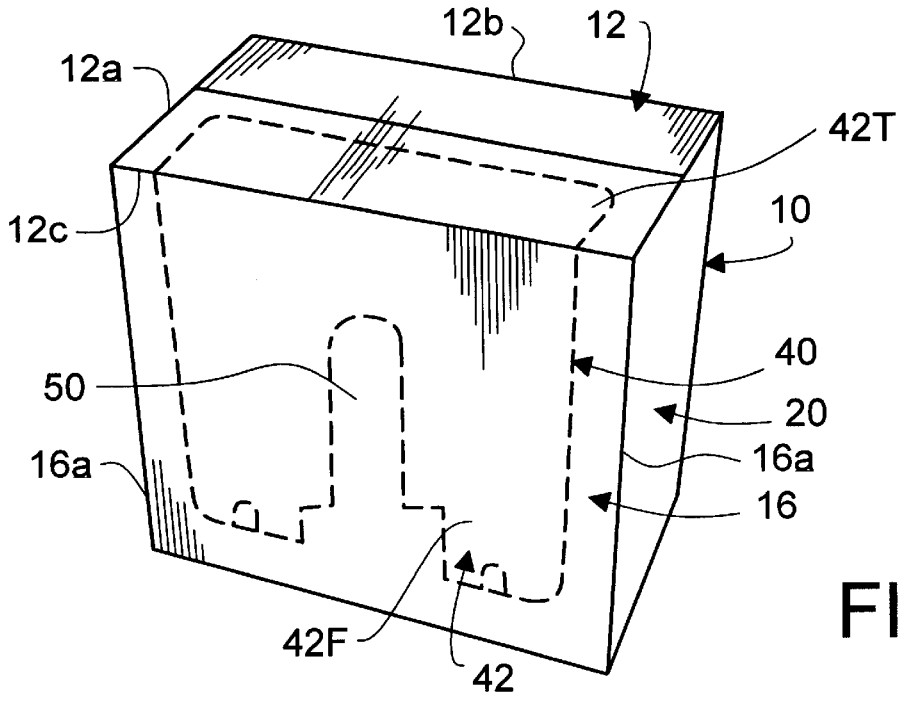
FIG. 1 is a top perspective view of a shipping/display box in a filled state ready for shipping.
Figure 2:
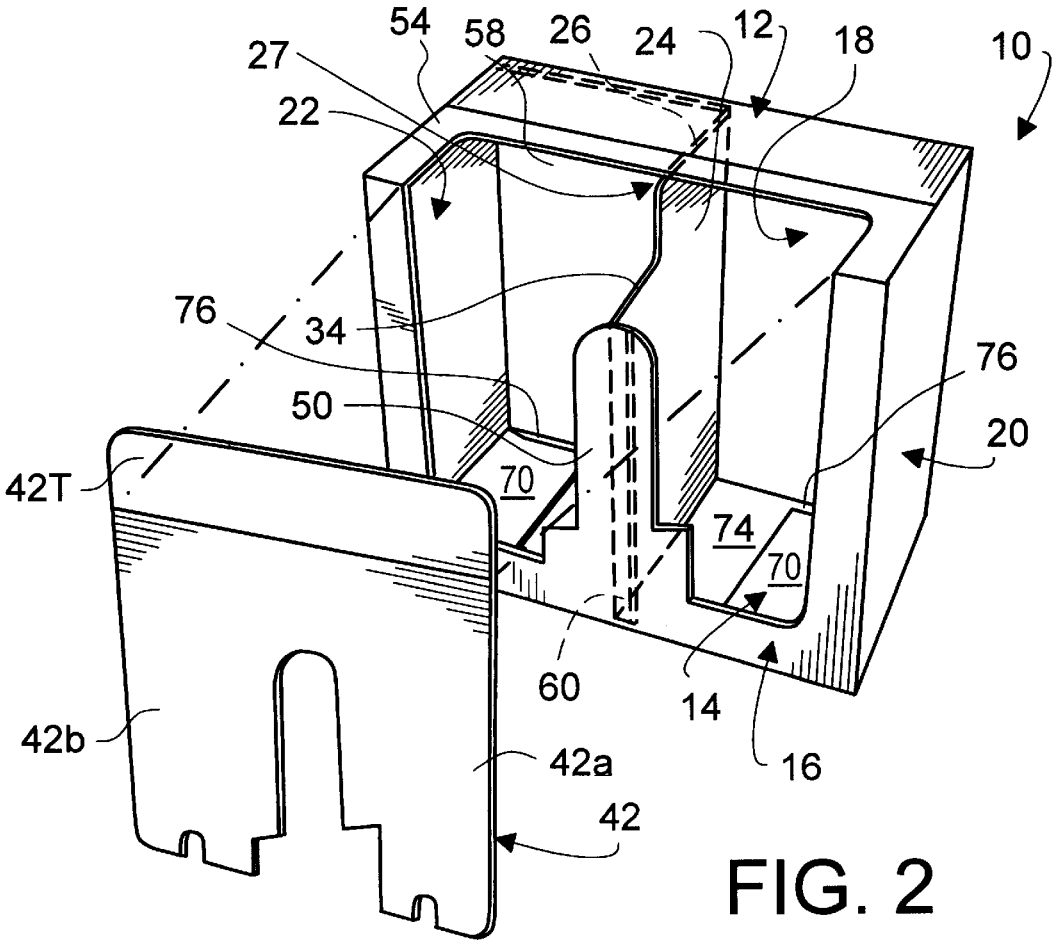
FIG. 2 is a view similar to FIG. 1 showing a tear-out segment removed from the box, with the box being empty.
Figure 3:
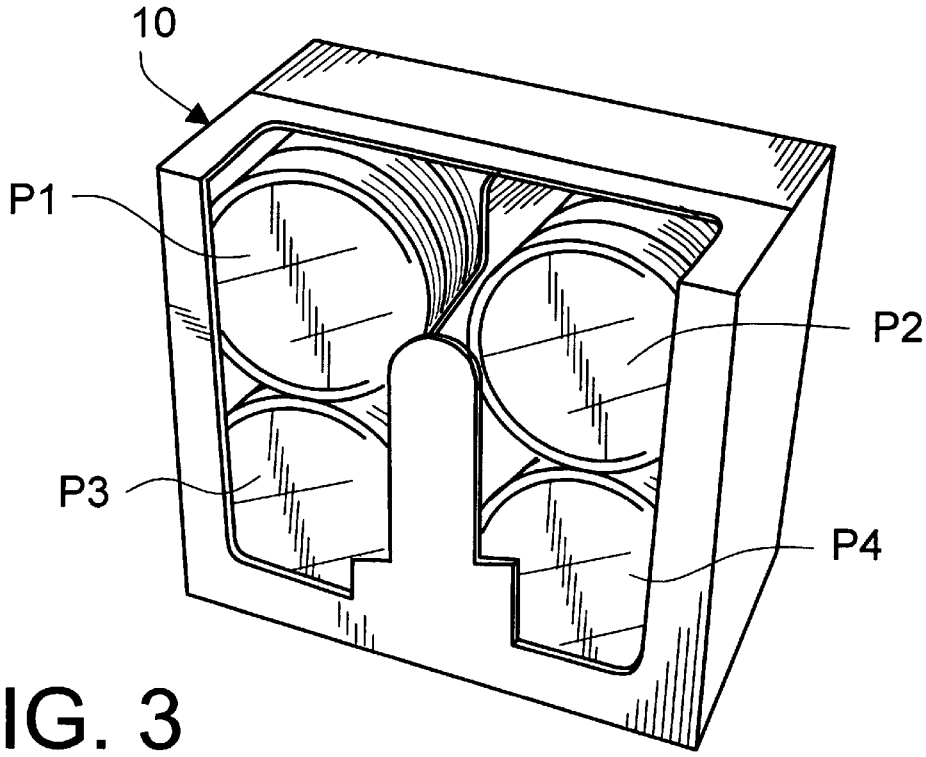
FIG. 3 is a top perspective view of the box after the tear-out segment has been removed, placing the box in a state for displaying articles therein.
Figure 4:
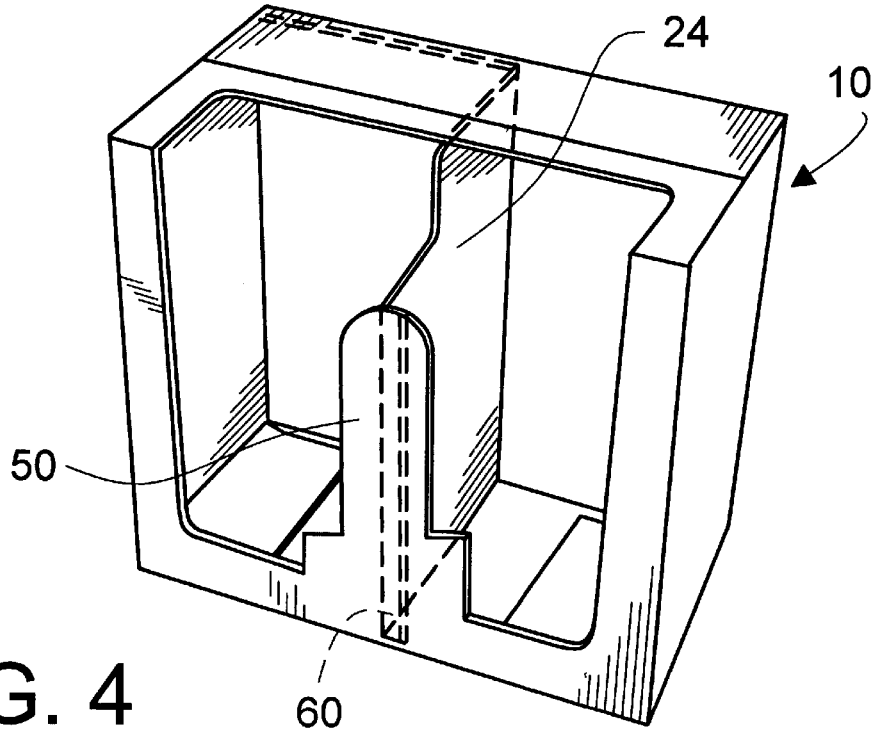
FIG. 4 is a view similar to FIG. 3 of an empty box.
Figure 5:
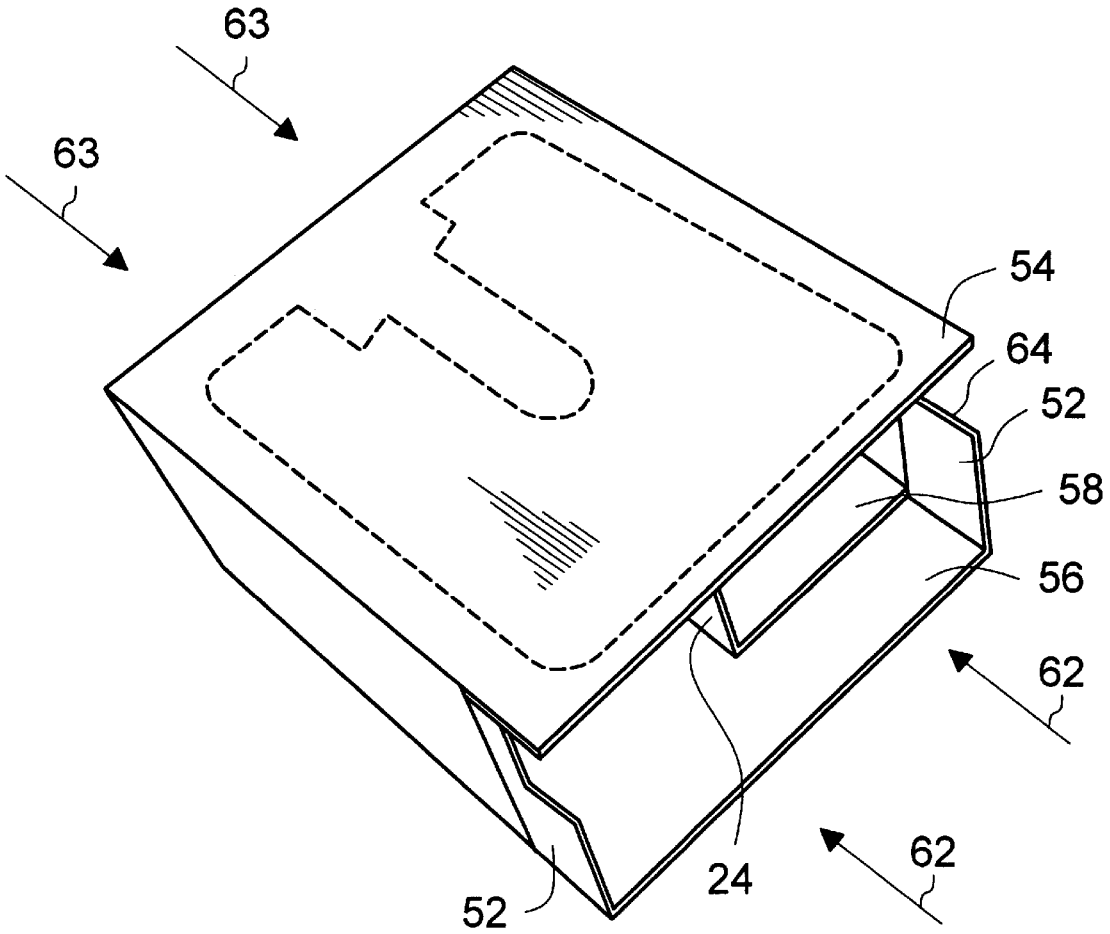
FIG. 5 is a perspective of the box in a state adapted for being loaded with articles.

A shipping/display box 10 depicted in FIGS. 1–5 is shown in a fully loaded state for shipping in FIG. 1. FIG. 2 shows a tear-out segment being removed to expose the interior of the box (no items contained in the box being depicted). FIG. 3 depicts the box in a display mode with contained items (e.g., packages of paper plates P) exposed. FIG. 4 depicts the box of FIG. 3 without the items P. FIG. 5 depicts the box in a state ready to be filled.

As shown in FIGS. 1 and 2, the box 10 is rectangular, having six sides and eight corners. The box includes an outer shell formed by a horizontal top side 12, a horizontal bottom side 14, parallel front and rear sides 16, 18 interconnecting the top and bottom sides 12, 14, and parallel vertical end sides 20, 22 also interconnecting the top and bottom sides 12, 14.

A vertical divider wall 24 is disposed inside the outer shell and extends perpendicular to the front and rear sides and parallel to the end sides 20, 22.

A rear portion 26 of the upper edge 27 of the divider panel 24 is flush with the top side 12, whereas a front portion 34 of the upper edge 27 is spaced below the top side 12 to form a recess. It will be appreciated that the rear portion 26 of the upper edge reinforces the top side 12 against vertical loading (e.g., other boxes stacked upon the box 10).

The front side 16 and top side 12 include perforations 40 defining a tear-out segment 42 that is spaced from all eight corners of the box. The tear-out segment includes a front portion 42F disposed in the front side, and a top portion 42T disposed in the top side. Thus, the perforations defining the front portion 42F of the tear-out segment are spaced from parallel vertical side edges 16*a* of the front side 16, and the perforations defining the top portion 42T of the tear-out segment are spaced from parallel horizontal side edges 12*a* and a horizontal rear edge 12*b* of the top side 12. The rear edge 12*b* extends parallel to a front edge 12*c* of the top portion 12.

The front side forms an upstanding strip 50 which divides the front portion 42F into a pair of legs 42*a*, 42*b*. The strip

50 is secured to a front vertical position of the divider panel 24, e.g., by an adhesive.

As shown in FIG. 5, the top side 12 is formed by: a pair of side flaps 52 extending integrally from the end sides, a front flap 54 extending integrally from the front side 16, and a rear flap 56 extending integrally from the rear side 18.

Integral with the divider panel 24 is a rear wall 58 that is bent at 90° relative to the binder panel. Preferably, that wall 58 is integral with the box blank, as can be seen from FIG. 6, although it could, alternatively, be a separate piece that is secured, e.g., by adhesive, to the rear side 18. An integral front end 60 of the divider panel 24 is also bent at a right angle and is secured (e.g., by adhesive) to an inside surface of the strip 50.

Figure 6:
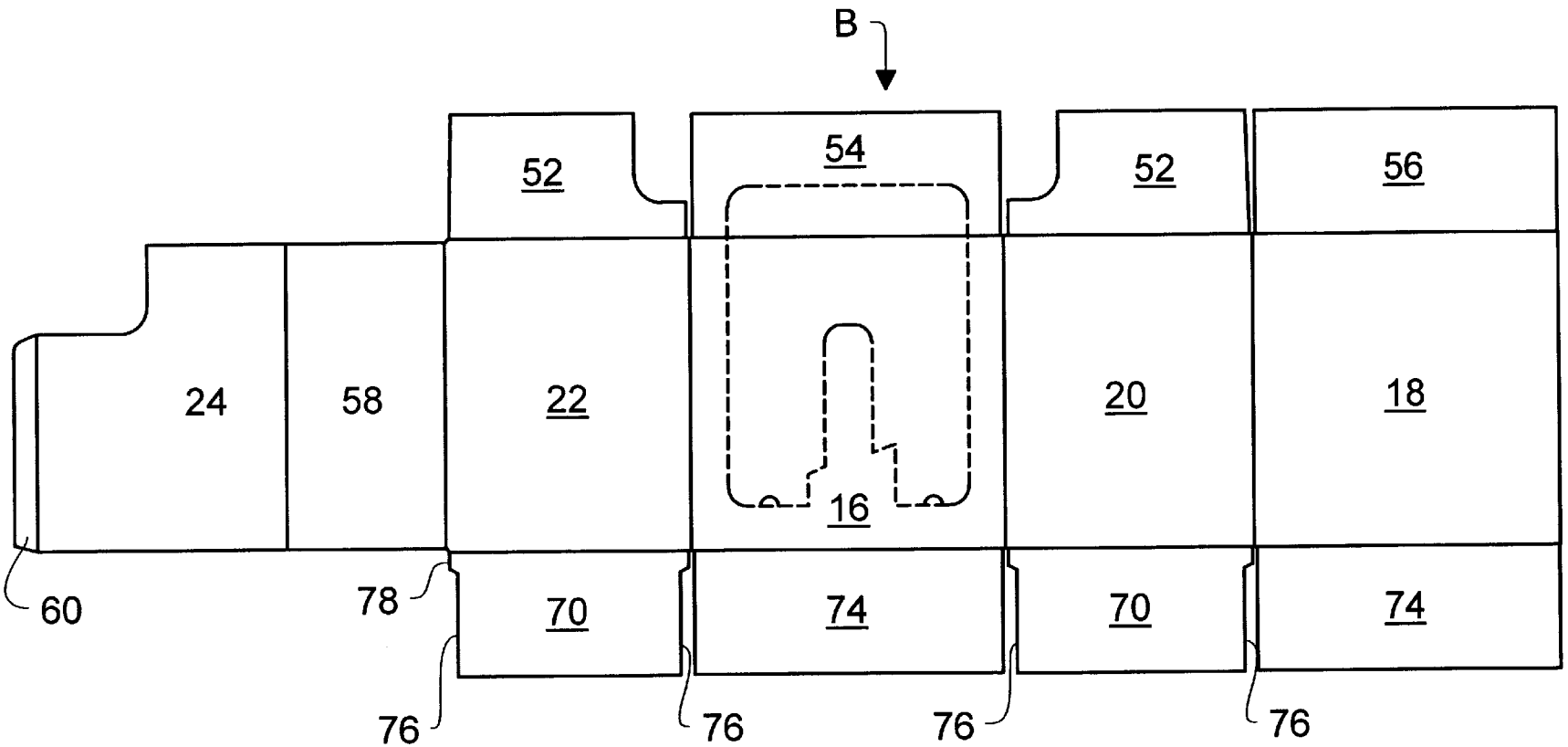
FIG. 6 is a plan view of a blank for forming the box depicted in FIGS. 1–5.

A blank B for forming the box is depicted in FIG. 6. It can be seen that the bottom side 14 includes a pair of minor flaps 70 and two bottom flaps 72 which will underlie the minor flaps 70 when the box has been erected. The minor flaps 70 are joined to lower edges of the end sides 20, respectively. Each of the minor flaps 70 includes a cut-out 76 disposed along a portion of an edge thereof which will be situated at the rear of the bottom side once the box has been erected. Each cut-out is spaced from the lower edge of a respective end side by a portion 78 of the minor flap 70.

Loading of the box, whether it be done manually or automatically, is facilitated. When it is desired to load the box 10, the packages P are introduced into the box between the divider panel 24. If loading is performed manually, the packages P are introduced in directions indicated by arrows 62. In the case of packages of paper plates, there are provided four horizontal rows P1, P2, P3, P4 of plates, with the plates lying in vertical planes and having their top sides facing forwardly.

Automatic loading by a conventional automatic loading machine is performed in the direction 63 so that the loading equipment need not contend with the recess formed by the front portion 34 of the divider panel 24, or with the large notches 64 formed in the side flaps 52. Loading in this direction 63 is facilitated by the cut-outs 76 formed in the minor flaps 70 which enables the box to pass through an automatic loading machine.

The packages are shipped in the box 10 depicted in FIG. 1. All of the perforations 40 are spaced from all edges of the box, so as to avoid weakening the box. Vertical loads are supported by the top side 12 which is reinforced by the plates. The area of the top side situated between the upper rows of packages P1, P2 is reinforced by the rear portion 26 of the upper edge 27 of the divider panel 24.

The divider panel 24 prevents the rows of packages P1, P2, P3, P4 from shifting during shipment and display, whereby those rows remain in neat orderly stacks.

Since the tops of the packages are exposed, due to the fact that part of the top side 42T is removed when the tear-out segments are removed, it is easier for a customer to remove the packages.

Since the box comprises only the outer shell and the divider panel, it is easier and less expensive to fabricate.

The box is also easier to load by a automated loading mechanism, since the divider 24 is vertically oriented rather than horizontally oriented.

The tear out segment 42 can be removed at a store to display the packages.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A shipping/display box comprising:

a horizontal top side;

a horizontal bottom side;

parallel vertical front and rear sides each interconnecting the top and bottom sides;

parallel vertical end sides each interconnecting the top and bottom sides;

a vertical divider panel disposed inside the box and extending perpendicular to the front and rear sides and parallel to the end sides, at least a portion of an upper edge of the divider panel supporting the top side from below;

the front side including parallel vertical side edges each extending from the bottom side to the top side;

the top side including parallel horizontal side edges each extending from the front side to the rear side, the top side further including parallel horizontal front and rear edges each extending from one end side to the other end side;

the front side and the top side including perforations defining a tear-out segment, the tear-out segment including a front portion disposed in the front side, and a top portion disposed in the top side, the front portion including a pair of vertical legs spaced apart by an upstanding strip of the front side, the strip secured to a front vertical edge of the divider panel;

the perforations defining the front portion of the tear-out segment being spaced inwardly from the vertical side edges of the front side;

the perforations defining the top portion of the tear-out strip being spaced inwardly from the horizontal side edges and the horizontal rear edge of the top side.

2. The shipping/display box according to claim 1 wherein the box has eight corners, and the tear-out segment is spaced from all of those eight corners.

3. The shipping/display box according to claim 2 wherein the divider panel extends from the bottom side to the top side for reinforcing the top side against vertical loading.

4. The shipping/display box according to claim 3 wherein the divider panel includes an upper edge, a front portion of the upper edge extending rearwardly from the upstanding strip and spaced below the top side.

5. The shipping/display box according to claim 3 wherein an upper edge of the upstanding strip is spaced below the top side.

6. The shipping/display box according to claim 5 further including a rear wall integral with a rear edge of the divider panel, the rear wall oriented parallel to the rear side and adhered thereto; a front wall being integral with a front edge of the divider panel, the front wall being parallel to the upstanding strip and adhered thereto.

7. The shipping/display box according to claim 1, wherein the divider panel extends from the bottom side to the top side for reinforcing the top side against vertical loading.

8. The shipping/display box according to claim 2, wherein the divider panel includes an upper edge, a front portion of the upper edge extending rearwardly from the upstanding strip and spaced below the top side.

9. The shipping/display box according to claim 1, wherein an upper edge of the upstanding strip is spaced below the top side.

10. The shipping/display box according to claim 1 wherein the top side, the bottom side, the front side, the rear side, the end sides and the divider panel are integrally formed on a one-piece blank.

11. The shipping/display box according to claim 1, further including a rear wall integral with a rear edge of the divider panel, the rear wall oriented parallel to the rear side and adhered thereto; a front wall being integral with a front edge of the divider panel, the front wall being parallel to the upstanding strip and adhered thereto.

12. The shipping/display box according to claim 12 wherein lower ends of the vertical legs of the tear-out segment are spaced vertically from a bottom horizontal edge of the front side.

13. The shipping/display box according to claim 1 wherein each of the end sides has a minor flap joined to a lower edge thereof, the minor flaps forming part of the bottom side, each of the minor flaps having a cut-out formed in an edge thereof extending along a rear of the bottom side, the cutout being spaced from the lower edge of the respective end side.

* * * * *